US009660325B2

(12) United States Patent
Haase et al.

(10) Patent No.: US 9,660,325 B2
(45) Date of Patent: May 23, 2017

(54) SENSOR AND MEASURING ARRANGEMENT

(71) Applicant: Endress + Hauser Conducta Gesellschaft für Mess- und Regeltechnik mbH + Co. KG, Gerlingen (DE)

(72) Inventors: Bjorn Haase, Stuttgart (DE); Hashem Amro, Stuttgart (DE); Stefan Robl, Hunxe (DE)

(73) Assignee: Endress+Hauser Conducta GmbH+Co. KG, Gerlingen (DE)

( * ) Notice: Subject to any disclaimer, the term of this patent is extended or adjusted under 35 U.S.C. 154(b) by 200 days.

(21) Appl. No.: 14/551,241

(22) Filed: Nov. 24, 2014

(65) Prior Publication Data

US 2015/0155892 A1 Jun. 4, 2015

(30) Foreign Application Priority Data

Nov. 29, 2013 (DE) ..... 10 2013 113 258

(51) Int. Cl.
*H01Q 1/22* (2006.01)
*H01Q 9/30* (2006.01)

(52) U.S. Cl.
CPC ..... *H01Q 1/2291* (2013.01); *H01Q 1/22* (2013.01); *H01Q 9/30* (2013.01)

(58) Field of Classification Search
CPC combination set(s) only.
See application file for complete search history.

(56) References Cited

U.S. PATENT DOCUMENTS 6,115,677 A 9/2000 Perthold
2005/0289276 A1 12/2005 Karschnia et al.
2006/0125484 A1* 6/2006 Wittmer ..... G01N 27/4035 324/438

(Continued)

FOREIGN PATENT DOCUMENTS

CN 1856704 A 11/2006
CN 1969238 A 5/2007

(Continued)

*Primary Examiner* — Junpeng Chen
(74) *Attorney, Agent, or Firm* — Mark A. Logan; PatServe

(57) ABSTRACT

A sensor for liquid and/or gas analysis comprising a measuring transducer for producing a measurement signal, and, connected with the measuring transducer, especially separably, a compact transmitter, which is embodied for receiving and further processing the measurement signal. The compact transmitter includes: a transmitter housing; a transmitter circuit arranged in the transmitter housing; arranged in the transmitter housing, a first interface, via which the transmitter circuit is connectable by means of a connection cable with a first superordinated data processing system, especially one embodied as a superordinated control system; and arranged in the transmitter housing, a second interface, which connects the transmitter circuit with an antenna and which is embodied to supply the antenna with, or to receive by means of the antenna, a radio signal, whose center frequency has a wavelength λ. The antenna includes a radiating element and at least one metal mirror element, and wherein the radiating element has a length of λ/8 up to 3λ/8, especially of, for instance, λ/4.

21 Claims, 3 Drawing Sheets

(56) References Cited

U.S. PATENT DOCUMENTS

| | | | | |
|---|---|---|---|---|
| 2012/0073989 | A1* | 3/2012 | Wilke | G01N 27/333<br>205/788.5 |
| 2012/0280867 | A1* | 11/2012 | Baek | H01Q 1/2283<br>343/700 MS |

FOREIGN PATENT DOCUMENTS

| | | | |
|---|---|---|---|
| CN | 101454813 | A | 6/2009 |
| CN | 201852655 | U | 6/2011 |
| CN | 102374853 | A | 3/2012 |
| DE | 10218606 | A1 | 11/2003 |
| DE | 102009028794 | A1 | 2/2011 |
| DE | 102011006067 | A1 | 9/2012 |
| EP | 0836732 | B1 | 4/1998 |
| EP | 2233994 | A2 | 9/2010 |

* cited by examiner 109
108
139
E
128
129
E-E

E
108
129
139
128
52
125
131
54
113
139

54
129
128
132
133

139
132
Z
128
125
137
113

105

SENSOR AND MEASURING ARRANGEMENT

TECHNICAL FIELD

The invention relates to a sensor and to a measuring arrangement, especially for process measurements technology.

BACKGROUND DISCUSSION

In process measurements technology, especially for automation of chemical processes or procedures for producing a product from a raw or starting material by use of chemical, physical or biological processes and/or for control of industrial plants, measuring devices installed near to the process, so-called field devices, are applied. Field devices embodied as sensors can monitor, for example, process measurement variables, such as pressure, temperature, flow, fill level or measured variables of liquid and/or gas analysis, such as, for example, pH-value, conductivity, concentrations of certain ions and of chemical compounds and/or concentrations or partial pressures of gases.

In a process installation, a large number of the most varied of sensors are frequently applied. A sensor arranged at a certain location of the installation in the process, for example, a sensor installed at a certain location of the installation and embodied for registering one or more measured variables, forms a measuring point.

A sensor includes, as a rule, a measuring transducer, which is embodied to register the measured variable to be monitored and to produce an electrical measurement signal correlated with the current value of the measured variable. Serving for additional processing of the measurement signal is a transmitter circuit, today most often an electronic transmitter circuit, which is embodied further to condition the electrical measurement signal, for example, to digitize it, to convert it into a measured value of the measured variable and/or into a variable derived from the measured value, and, in given cases, to output such to a superordinated unit. The transmitter circuit can include, besides the measured value formation and measured value forwarding, more extensive functions. For example, it can be embodied to perform a more extensive evaluation of the measured values or to perform a sensor diagnostics, in the case of which a current state of the sensor is determined and/or a prediction made concerning the remaining life of the sensor.

In the case of sensors of the aforementioned type, especially in the field of liquid- and gas analysis, the respective transmitter circuit is frequently connected with a superordinated data processing system, which is arranged most often spatially removed from the respective measuring point and to which the measured values, diagnosis relevant data or other sensor data produced by the respective sensor are forwarded. The superordinated data processing system can especially comprise one or more electronic, process controllers, for example, one or more measurement transmitters installed on-site, a process control computer or a programmable logic controller (PLC).

Serving for data transmission frequently in such industrial measuring arrangements, at least sectionally, are fieldbus systems, such as, for example, FOUNDATION Fieldbus, PROFIBUS, ModBus, etc. or, for example, also networks based on the Ethernet standard, as well as the corresponding, most often application independently standardized, transmission protocols.

In more recent time, sensors for liquid and gas analysis have a transmitter circuit, which is accommodated in a compact housing connectable fixedly or releasably with the measuring transducer. Such a transmitter circuit accommodated in a compact housing connected fixedly or releasably with the measuring transducer and providing at least parts of the measurement transmitter functionality, especially the further processing of the measurement signal and the forwarding of the processed measurement signal to at least one superordinated unit and connectable via interfaces with the measuring transducer, on the one hand, and with the superordinated data processing unit, on the other hand, is also referred to as a compact transmitter.

Thus, known from Published International Patent Application, WO 2005/031339 A1 is a liquid sensor, which is connected via a coupling with a measurement transmitter and further with a superordinated data processing system. The sensor includes a measuring transducer, as well as, accommodated in a compact housing fixedly connected with the measuring transducer, a sensor circuit, which has a preprocessing circuit for preprocessing the analog measurement signals produced by means of the measuring transducer, an analog/digital converter for converting the registered analog measurement signals into digital measurement signals and a first interface for transferring the digital measurement signals to the superordinated measurement transmitter. The coupling includes a sensor side, primary coupling element and a complementary, secondary coupling element, which is connected with the measurement transmitter. The first interface is embodied to transmit the digital measurement signals via the coupling to the measurement transmitter. The secondary coupling element includes another electronic circuit, which includes, complementary to the first interface, a second interface, which is embodied to receive the measurement signals transmitted from the first interface. The second interface can, moreover, transmit data as well as energy via the coupling to the first interface of the sensor. The secondary coupling element can in a first embodiment be connected via a connection cable with the measurement transmitter for data communication. In a second embodiment, the secondary coupling element includes, instead of an interface connected via a cable with the measurement transmitter, a microcontroller, which is connected with a radio module having an antenna, which serves for data transmission to a superordinated unit. Not known from WO 2005/031339 A1 is an embodiment, in the case of which the compact transmitter simultaneously communicates via a cable connection and a radio connection with one or more superordinated data processing systems. Also, no information is given relative to the details of the secondary coupling element and the antenna.

Described in European Patent, EP 2 233 994 A2 is a measuring arrangement, which includes an intelligent process sensor, which is connectable releasably with a compact electronics module. The process sensor serves for determining at least one chemical or physical, measured variable of a measured medium and includes, besides a measuring transducer for registering this measured variable, an electronics unit inseparably connected with the measuring transducer. This electronics unit includes a means for monitoring the sensor state, a means for digitizing the analog measurement data from the sensor unit, a means for forwarding the analog and digitized data, at least one analog interface and at least one digital interface for connection of the process sensor with the process control system as well as galvanic isolation between the measured medium and the interfaces. The electronics unit connected inseparably with the measuring transducer serves to process measurement data, to monitor the sensor state and to store the sensor relevant data.

The electronics module serves to output the data and diagnostic information provided by the intelligent sensor via one or more interfaces, for example, to a process control system or a mobile servicing device according to a communication protocol processable by the process control system, respectively the mobile servicing device. The electronics module includes a microprocessor with a memory unit, a plurality of digital interfaces, and a means for forwarding analog signals of the process sensor to a process control system. One of these digital interfaces can be designed as a radio interface with transmitting unit and antenna. EP 2 233 994 A2 gives no information concerning the exact embodiment and arrangement of the different interfaces, including the radio interface.

In operation, such sensors for liquid or gas analysis with electronics unit serving as compact transmitter are installed near to the process or even contact the process, in given cases, by applying retractable assemblies integrated in a wall of a process container. Influences of dielectrics located in the environment of the compact transmitter as a result of this installed situation can lead to a degrading of the signal quality of a radio signal output, or received, via a radio interface of the compact transmitter. At the same time, in the case of such sensors with compact transmitters, as a result of their compact construction, the space for antenna systems for a radio interface is limited, especially when an additional cable connection of the sensor with a superordinated unit should be present.

SUMMARY OF THE INVENTION

It is, consequently, an object of the invention to provide a sensor with a compact transmitter, which includes means for communication with a superordinated data processing system, especially a mobile servicing device, by means of a radio connection with sufficient signal quality, coupled with as compact as possible construction.

This object is achieved according to the invention by a sensor which includes a measuring transducer for producing a measurement signal and, connected with the measuring transducer, especially separably, a compact transmitter, which is embodied for receiving and further processing the measurement signal, wherein the compact transmitter includes:

- a transmitter housing;
- a transmitter circuit arranged in the transmitter housing;
- arranged in the transmitter housing, a first interface, via which the transmitter circuit is connectable by means of a connection cable with a first superordinated data processing system, especially one embodied as a superordinated control system; and
- arranged in the transmitter housing, a second interface, which connects the transmitter circuit with an antenna and which is embodied to supply the antenna with, or to receive by means of the antenna, a radio signal, which has a central wavelength $\lambda$, wherein the antenna includes a radiating element and at least one metal mirror element, and wherein the radiating element has a length of $\lambda/8$ up to $3\lambda/8$, especially, for instance, $\lambda/4$.

The radio signal includes a predetermined center frequency, onto which one or more data signals to be transmitted can be modulated. The center frequency corresponds to the central wavelength $\lambda$, which results from the quotient of the speed of light and the center frequency ($\lambda=c/f$).

The process near or process contacting, installed situation of the sensors for liquid or gas analysis can lead in measurement operation to the fact that a compact transmitter connected fixedly or releasably with the measuring transducer, depending on measurement task of the sensor, is exposed to the most varied of dielectric environments or over the duration of operation of the sensor to a variable dielectric environment, e.g. due to increased humidity, condensed water forming on the transmitter housing or even due to the influence of a retractable assembly. A change of the dielectric environment of the compact transmitter effects a shifting of the central wavelength, for which an antenna of the compact transmitter is initially matched. For example, an antenna located in air and designed for 2.45 GHz, upon introduction into a dielectric medium, "detunes" to smaller frequencies, because the effective wavelength is less within the dielectric material. The embodiment of the antenna of the compact transmitter as a so-called lambda/4 antenna with a radiating element with a length of, for instance, a fourth of the central wavelength, enables a radio transmission with sufficient signal quality in a relatively broad frequency window of ±300 MHz around the center frequency. In contrast therewith, such a "broadbandedness" cannot be achieved in the case of conventional compact chip antennas, which, as a rule, initially assure a sufficient signal quality only in a narrowband window around the center frequency, e.g. of 2.45 GHz ±30 MHz. A detuning of the center frequency, respectively the central wavelength, due to a changed dielectric environment in an order of magnitude to be expected in process measurement applications (of around, for example, 5%) would in the case of application of a conventional chip antenna lead to an intolerable signal degradation.

Advantageously, the radiating element has a length of, for instance, $\lambda/4$, thus a fourth of the central wavelength. Since the optimal length of the radiating element relative to the desired broadbandedness depends, however, on the dielectric environment of the radiating element, the length of the radiating element can be selected between $\lambda/8$ and $3\lambda/8$, thus between an eighth of the central wavelength and three eighths of the central wavelength, as a function of the dielectric environment of the radiating element, e.g. for the case, in which the radiating element is embedded in a potting material, which leads to a detuning of the central wavelength, or when the antenna from the outset should be tuned taking into consideration that the sensor including the compact transmitter will be installed in a retractable assembly during operation.

In the case of a center frequency of, for example, 2.45 GHz, the central wavelength amounts to, for instance, 12.3 cm, thus, the length of the radiating element lies in a range between 1.5 and 4.6 cm, preferably at, for instance, 2.5 to 3.5 cm, especially preferably at, for instance, 3 cm.

The second interface can be embodied to supply the antenna with a radio signal, respectively to receive such a radio signal from the antenna, according to a Bluetooth standard, especially according to an energy-saving mode (HOLD, SNIFF, PARK) or according to the Bluetooth low energy protocol, or according to wireless HART and to forward such to the transmitter circuit. The second interface can especially be embodied to supply to the antenna as a radio signal data obtained from the transmitter circuit, especially a measured value ascertained from the measurement signal of the measuring transducer, sensor parameters or status information of the sensor. It can supplementally be embodied to receive from a superordinated data unit sensor parameters, interaction commands or other operating data as radio signals according to one of the said protocols or standards and to transmit such to the transmitter circuit.

The measuring transducer and the compact transmitter can be connected separably with one another by means of a pluggable connector coupling, wherein the compact transmitter includes a third interface, which is embodied to transmit data signals obtained from the transmitter circuit to a complementary interface of the measuring transducer and to receive data signals, especially the measurement signal, from the interface of the measuring transducer and to transmit such to the transmitter circuit, when the measuring transducer and the compact transmitter are connected by means of the pluggable connector coupling. The third interface can supplementally serve for supplying the measuring transducer with energy by transmitting such to the interface of the measuring transducer.

In a preferred embodiment, the measuring transducer is rod-shaped and includes in a front end region a transducing mechanism for registering the measured variable to be monitored and converting such into an electrical, as a rule, analog, signal. On the opposing, rear end of the measuring transducer in this embodiment, the transmitter housing is arranged, wherein the connection cable is led out from the rear end, i.e. the end of the transmitter housing facing away from the measuring transducer. Preferably, the antenna, especially the radiating element, is arranged in the rear end region of the transmitter housing and can have a section protruding out from the transmitter housing. Advantageous in this embodiment is that the antenna has a maximum separation from the process to be monitored, and, thus, process influences on the dielectric environment of the antenna are minimized. Also, in the case of this embodiment, the sensor can be so arranged in a retractable assembly that the antenna protrudes out from the retractable assembly, so that also the retractable assembly has no or only small influence on the dielectric environment of the antenna.

The transmitter housing can have at least one cylindrical section. In an embodiment, the cylindrical section of the transmitter housing has an outer diameter of less than 30 mm, preferably less than 20 mm, especially preferably less than 16 mm. This permits arrangement of the sensor including the transmitter housing in most retractable assemblies used in process measurements technology.

The antenna can be embodied, for example, as a lambda/4 monopole antenna or as an F antenna.

In an additional embodiment, at least one section of the radiating element and one section of the connection cable within the transmitter housing extend facing one another, in each case, spaced from the cylinder axis of the cylindrical section of the transmitter housing, especially parallel to one another. In the case of sensors for liquid and gas analysis known from the state of the art, a connection cable to a superordinated unit is led basically centrally out of the housing, i.e., as a rule, coinciding with the cylinder axis of a cylindrical housing. Since both the radiating element as well as also the connection cable extend spaced from the cylinder axis and lie facing one another, a greatest possible separation can be maintained between the connection cable and the radiating element. In this way, a disturbance of the signal quality of radio signals transmitted via the antenna caused by the connection cable is minimized even in the case of the limited space available in a compact transmitter.

The radiating element can be embodied as a conductive trace structure, especially a copper structure, applied on at least one circuit card. Also, an embodiment of the radiating element provides the radiating element as a piece of bent sheet metal soldered on the circuit card. The embodiment of the radiating element as a conductive trace structure of a circuit card has, compared with the sheet metal part, the advantage that conductive trace structures are manufacturable with a significantly greater accuracy, thus lesser length tolerances.

In an embodiment, the radiating element has a base, via which it is connected with the second interface, wherein the circuit card has in the region of the base a copper structure, which acts as part of a matching network, especially with inductive impedance, for compensating a capacitive coupling between the radiating element and the at least one mirror element.

The at least one mirror element can comprise a ground plane of metal, especially copper, arranged on an inner ply of the circuit card.

The first interface can be arranged at least partially on the circuit card, wherein the connection cable can be connected via at least one soldered connection fixedly with the circuit card. The second interface can comprise HF circuit parts, which are arranged on the same circuit card as the first interface, wherein the HF circuit parts and the conductor structure forming the radiating element are arranged on an upper side of the circuit card, and the soldered connection of the connection cable is arranged on the underside of the circuit card lying opposite the upper side. By this arrangement of the radiating element and the HF circuit parts on one side of the circuit card and the soldered connection of the connection cable on the other side of the circuit card, the ground plane of the mirror element arranged therebetween on an inner ply of the circuit card can simultaneously shield the radiating element and the HF circuit parts from the undefinedly situated and not always equally soldered, individual strands of the connection cable.

The radiating element, the transmitter circuit, the first interface and the second interface can be arranged on the same circuit card. The circuit card can be embodied as a rigid circuit card or at least partially as a rigid-flex circuit card or as a flexible circuit card.

In an embodiment, the second interface can be arranged at least partially on an additional circuit card, which is arranged perpendicularly to, and preferably fixedly connected with, the circuit card, on which the conductor structure forming the radiating element is formed.

The first interface and/or the transmitter circuit can be arranged at least partially on the additional circuit card, wherein the connection cable is connected fixedly with the additional circuit card via at least one soldered connection, wherein the second interface includes HF circuit elements, which are likewise arranged on the additional circuit card, and wherein the HF circuit parts and a soldered connection between the circuit card, on which the conductor structure forming the radiating element is formed, and the additional circuit card is arranged on an upper side of the additional circuit card, and the soldered connection of the connection cable is arranged on the underside of the additional circuit card lying opposite the upper side.

In this embodiment, the at least one mirror element can comprise a ground plane of an electrically conducting material, especially of copper, arranged on an inner ply of the additional circuit card.

The transmitter circuit, at least parts of the second interface and at least parts of the first interface are thus in this embodiment arranged on a first circuit card, while the conductive trace structure forming the radiating element is arranged on a second circuit card perpendicular to the first circuit card. Preferably, the second circuit card is connected fixedly with the first circuit card, for example, by means of a soldered connection. For this, the second circuit card can be sectioned along a line of intersection extending through at least one via, and the at least one via can serve as solder joint.

In an additional embodiment, the radiating element can be led concentrically helically around the connection cable. The first interface can in this embodiment be arranged at least partially on a circuit card and the connection cable can be connected via at least one soldered connection fixedly with the circuit card, wherein the at least one mirror element is formed by a ground plane of a metal, especially copper, arranged on an inner ply of the circuit card.

In the vicinity of the soldered connection between the connection cable and a circuit card comprising the first interface, the connection cable can be surrounded by a tubular, plastic part, which is arranged coaxially to the connection cable and on which the radiating element is helically wound. The plastic part can have guiding means for the radiating element, especially a helical groove cut into the outside of the plastic part.

In all of the above described embodiments, the first interface can be arranged at least partially on a circuit card, and the connection cable fixedly connected with the circuit card via at least one soldered connection. Arranged in the region of the soldered connection for strain relief of the connection cable can be an apparatus preferably formed completely of a dielectric material, especially a synthetic material, such as a plastic. For example, the apparatus for strain relief can be implemented by means of a cable tie. Used for this can be, for example, a conventional cable tie of plastic. The circuit card, on which the first interface is at least partially arranged in this embodiment, can be, for example, the same circuit card, on which the radiating element is arranged in the form of a conductive trace structure, or an additional circuit card arranged perpendicularly to the circuit card, on which the radiating element is arranged in the form of a conductive trace structure.

The transmitter circuit can include a computer system and a memory associated with the computer system, wherein there is stored in the memory a computer program, which is executable by the computer system and which serves for the additional processing of a measurement signal transmitted via the third interface from the measuring transducer connected with the compact transmitter, especially for determining a current measured value, and for transmission of the further processed measurement signal via the first interface to the first superordinated data processing system. Stored in the memory associated with the computer system can be, moreover, a computer program, which is executable by the computer system and which serves for transmission of the further processed measurement signal and/or other data, especially for transmission of sensor parameters, via the second interface per radio to a second data processing system.

A measuring arrangement of the invention includes:

- a sensor according to one of the above described embodiments;
- connected with the compact transmitter via the second interface, a first superordinated data processing system, especially one embodied as a control system; and
- a second superordinated data processing system connected with the transmitter circuit via a radio connection to the third interface, especially a superordinated data processing system embodied as a handheld, smart phone, tablet PC, notebook or as a display system embodied for wireless communication with the evaluation circuit.

The transmitter circuit can be embodied further to process the measurement signal delivered from the measuring transducer, especially to determine based on the measurement signal a measured value of the variable to be monitored measured by the sensor, to convert the calculated measured value into a signal according to a communication protocol processable by the first and/or second data processing system and to forward such to them.

The second superordinated data processing system can be embodied to communicate with the transmitter circuit via a radio connection according to a Bluetooth standard, especially according to an energy saving mode (HOLD, SNIFF, PARK) or according to the Bluetooth low energy protocol, or via wireless HART via the third interface of the compact transmitter. Equally, the third interface of the compact transmitter is embodied to supply the antenna with a radio signal according to one of the said standards. The radio signal can comprise, for example, data produced by the transmitter circuit, especially a measured value ascertained from the measurement signal, sensor parameters and/or status information, which represent the current sensor state or a loading history of the sensor.

The sensor can be, for example, a sensor for measuring the pH-value, the conductivity, the oxygen content, an ion concentration, the chlorine content, the ozone content, the turbidity or a solids content of a liquid.

BRIEF DESCRIPTION OF THE DRAWINGS

The invention will now be explained in greater detail based on the illustrated examples of embodiments set forth in the appended drawing, the figures of which show as follows.

DETAILED DISCUSSION IN CONJUNCTION WITH THE DRAWINGS

Figure 1:
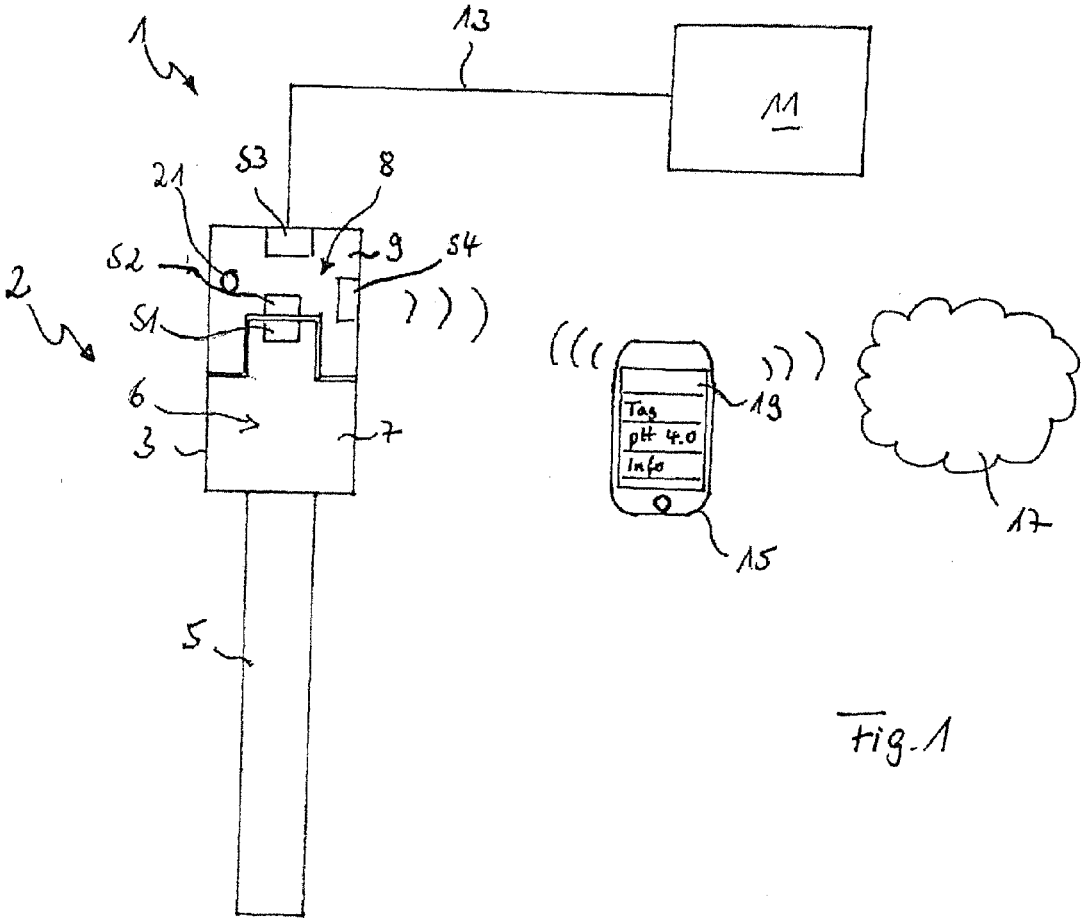
FIG. 1 is a schematic representation of a first example of an embodiment for a measuring arrangement with a sensor with compact transmitter, a superordinated first data processing system, and a second superordinated data processing system connected via radio with the compact transmitter.

FIG. 1 is a schematic view of a measuring arrangement 1. The measuring arrangement 1 includes a sensor 2 with a measuring transducer 3, which includes a transducing mechanism 5, for example one embodied as a potentiometric measuring chain, and, fixedly connected with the transducing mechanism 5 and enclosing a measuring transducer circuit 6, a housing, which simultaneously forms a measuring transducer side, primary coupling element 7 of a plugged connection. The transducing mechanism 5 serves for producing a primary signal representing the measured variable. The primary signal is registered by means of the measuring transducer circuit 6, in given cases, further processed and transmitted via a measuring transducer interface S1 to a first interface S2 of a compact transmitter 9. First interface S2 is complementary to the measuring transducer interface S1. Compact transmitter 9 serves in the present example simultaneously as the secondary coupling element complementary to the primary coupling element 7. Compact transmitter 9 includes a transmitter housing, in which is accommodated besides the first interface S2 a transmitter circuit 8. The transmitter circuit 8 of the compact transmitter 9 serves for processing and forwarding the measurement signals of the transducing mechanism 5 received via the interface S2. The transmitter housing surrounds the transmitter circuit 8, especially liquid tightly, and so protects it from environmental influences. Also the housing of the measuring transducer side, coupling element 7 is liquid tight and so protects the measuring transducer circuit 6 from environmental influences. Transmitter circuit 8 is embodied as an electronic circuit, which can be arranged within the transmitter housing on a circuit card, especially a multi-ply circuit card, especially a flexible circuit card or a rigid-flex circuit card.

Transmitter circuit 8 is connected with a first superordinated data processing system 11, which can be, for example, a process control system, especially one involving a PLC. The connection can be implemented, for example, by means of a fieldbus 13. For transmission of data from the transmitter circuit 8 to the first superordinated data processing system 11 via the fieldbus 13, respectively for receiving data from the superordinated data processing system 11 by the transmitter circuit 8, transmitter circuit 8 includes a fieldbus interface S3. Via the interface S3, the measuring transducer 3, including the measuring transducer circuit 6, and the transmitter circuit 8 are supplied with energy by the first superordinated data processing system 11.

Data communication between the transmitter circuit 8 and the superordinated first data processing system 11 occurs by means of a communication protocol, which can be processed by the superordinated data processing system 11, for example, by means of a standard fieldbus communication protocol such as HART, PROFIBUS PA, PROFIBUS DP, Foundation Fieldbus, ModBus. In the present example, interface S3 is embodied to enable communication of the evaluation circuit with the superordinated unit via a 4 . . . 20 mA HART signal and includes a two-conductor, electrical current output. Equally, the here described invention can, however, also be implemented with a measuring arrangement, in the case of which the evaluation circuit uses a four-conductor, electrical current output and in the case of which the communication occurs by means of a 4 . . . 20 mA HART signal or by means of one of the others of said standard fieldbus communication protocols.

The pluggable connector coupling formed by the coupling element 7 and the compact transmitter 9 serving as secondary side, coupling element is embodied in the present example as an inductive coupling. The interfaces S1, S2 of the two coupling parts comprise, in each case, a coil, between which energy and data can be inductively transmitted. This has the advantage that the pluggable connector coupling simultaneously assures galvanic isolation of the measuring transducer 3 from the superordinated data processing system 11, respectively the transmitter circuit 8. Alternatively, the pluggable connector coupling can, however, also be embodied as a galvanically coupling, plugged connection. In such case, it is advantageous, to provide galvanic isolation within the measuring transducer circuit 6 or within the transmitter circuit 8.

Compact transmitter 9 includes an optical display 21, which can comprise e.g. an LED, for visual display of a state of the communication connection via the pluggable connector coupling. The display can be embodied, for example, as a multi-colored LED. In this case, a color corresponds to a certain state of the communication connection. In a variant, the optical display 21 can also serve to indicate sensor states, e.g. a sensor defect, or other, system states. It is also possible to use just a single color LED. In this case, mutually differing blink frequencies can serve for visualizing system states or communication states.

Transmitter circuit 8 includes another interface S4, which is embodied in the present example as a radio interface. Interface S4 comprises a radio transceiver, which is embodied, to supply an antenna with a radio signal to be communicated to a second superordinated data processing system 15, for example, a radio signal according to a Bluetooth or Bluetooth LE standard, respectively to receive by means of the antenna a radio signal from the second superordinated data processing system 15, for example, a radio signal according to one of the said standards. The second superordinated data processing system 15 is embodied in the present example as a smart phone. It includes besides a radio interface embodied for radio communication with the interface S4 of the transmitter circuit 8, for example, a radio interface according to a Bluetooth or Bluetooth LE standard, an Internet interface, via which it can communicate, for example, per WLAN, GSM or UMTS, with a radio network 17, especially an intranet or the Internet. The radio signals transmitted by means of the interface, respectively received from the second superordinated data processing system 15, have a central wavelength $\lambda$, for which the radio interfaces and the antennas serving for transmission, respectively receiving, are initially matched.

The smart phone serving as second superordinated data processing system 15 includes a display and input means 19, which is embodied in the present example as a touch screen. Stored in a memory of the data processing system 15 is a servicing software, which is executable by the data processing system 15. The servicing software is embodied to provide an HMI, which by means of one or more menus displays measurement and sensor data and/or measuring point parameters and provides a user with the opportunity for input or selection of parameters and for input or selection of commands for the transmitter circuit 8.

Figure 2:
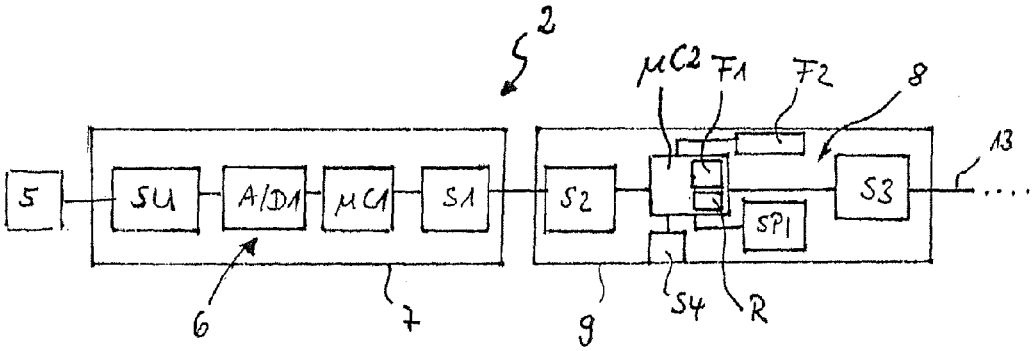
FIG. 2 is a schematic detail view of the sensor and of the compact transmitter of the measuring arrangement illustrated in FIG. 1.

FIG. 2 shows schematically the sensor 2 with the measuring transducer 3 and the compact transmitter 9. The measuring transducer circuit 6 includes an analog measurement circuit SU, which in interaction with the transducing mechanism 5 produces an analog measurement signal in the form of a measurement voltage or measurement current. The measurement signal is digitized by the analog/digital converter A/D1 and output to a first microprocessor μC1, which is embodied to prepare the measurement signal for transmission via the interface S1 to the interface S2 of the transmitter circuit 8. The first microprocessor μC1 includes an internal memory. Moreover, the measuring transducer circuit 6 can include at least one additional memory (not shown), which the first microprocessor μC1 can access. Contained in this memory can be especially sensor-specific parameters, e.g. up-to-date calibration parameters, e.g. the parameters, zero-point and slope, characterizing a sensor characteristic curve. Such memory can also contain current contents of counters.

Transmitter circuit 8 includes a second microprocessor μC2, which, among other things, is embodied to calculate from the measurement signal a measured value of the measured variable. Microprocessor μC2 includes an internal flash memory F1 and an internal RAM R. Moreover, it can access a first supplemental memory SPI, which is embodied as bulk memory. Stored in the supplemental memory SPI and serving, for example, for implementing operating functions of the sensor, e.g. sensor diagnostics, are a number of program modules, which, when required, can be loaded into the internal flash memory F1, in order to be executed by the microprocessor μC2. The microprocessor μC2 can, moreover, access a second supplemental memory F2, in which are durably stored configuration data or other sensor- or measuring point referenced data, which can change during operation of the sensor 3. Microprocessor μC2 is, moreover, connected with the interface S3 to the superordinated data processing system 11 and with the interface S4, which serves for radio communication with the second superordinated data processing system 15.

In an alternative embodiment (not shown), the transmitter circuit 8 can also be accommodated together with the measuring transducer circuit 6 in a single housing, which, in given cases, is fixedly connected with the transducer mechanism. In this case, the compact transmitter of the sensor is fixedly and inseparably connected with the measuring transducer.

Figures 3, 4, 5, 6:
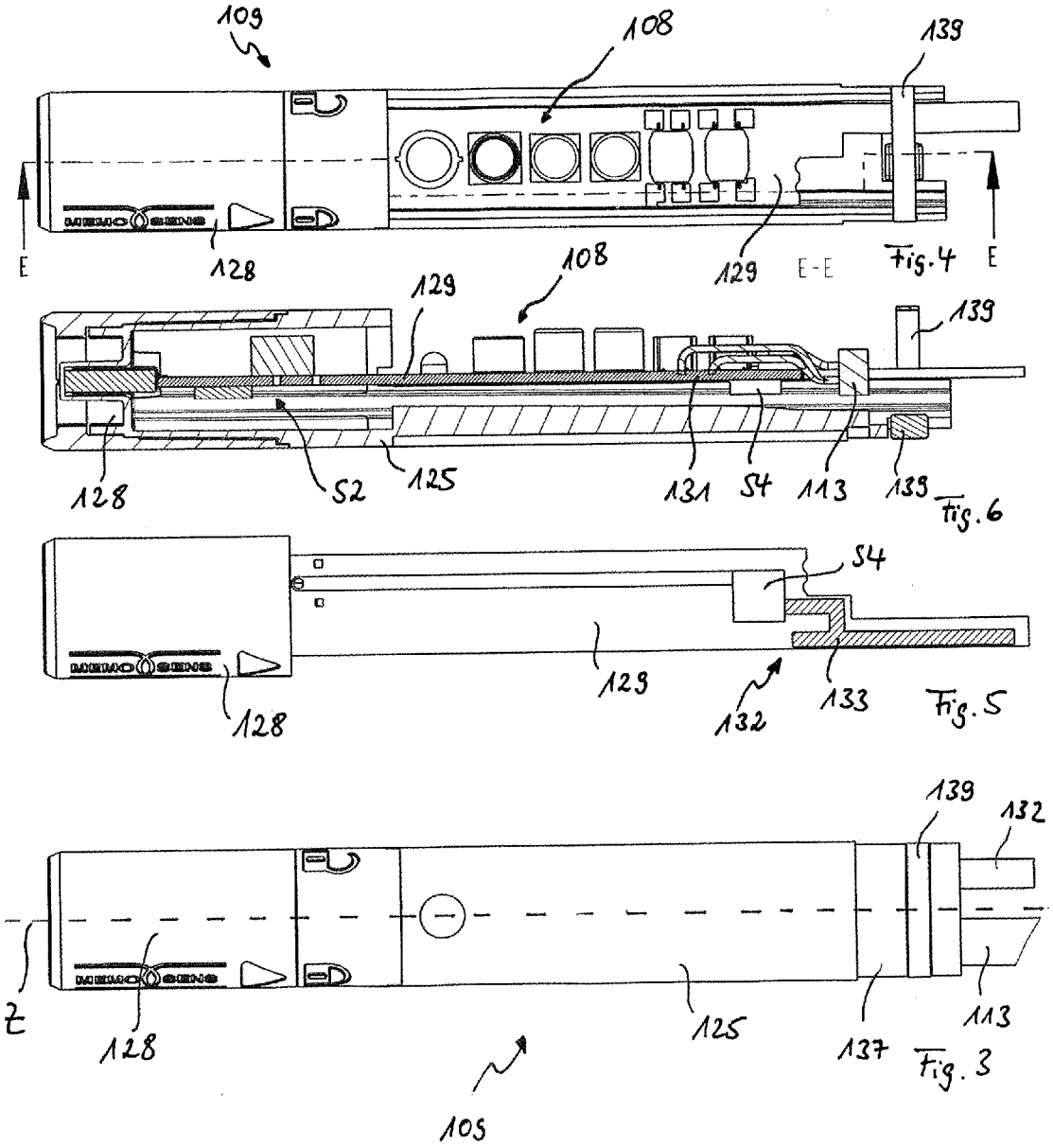
FIG. 3 is a schematic representation of a compact transmitter with a connection cable for connection of the compact transmitter with a first superordinated data processing system and an antenna for establishing a radio connection with a second superordinated data processing system according to a first example of an embodiment.
FIG. 4 is a first detail view of the compact transmitter illustrated in FIG. 3, showing the front side of the circuit card bearing the transmitter circuit.
FIG. 5 is a second detail view of the compact transmitter illustrated in FIG. 3, showing the rear side of the circuit card bearing the transmitter circuit.
FIG. 6 is a sectional illustration of the compact transmitter illustrated in FIG. 3.

FIG. 3 shows a compact transmitter 109 for application in a measuring arrangement according to FIGS. 1 and 2 according to a first example of an embodiment. FIG. 4 shows a first detail view of the compact transmitter 109 showing the front side of the circuit card 129 bearing the transmitter circuit 108. FIG. 5 shows the rear side of the circuit card 129. FIG. 6 shows a sectional illustration of the compact transmitter 109 taken along the cutting plane E-E of FIG. 4. Identical components are provided in FIGS. 3 to 6 with identical reference characters.

Compact transmitter 109 has an essentially rotation symmetric housing 125 of synthetic material with a cylindrical section, which defines a cylinder axis Z. Formed on its measuring transducer end is a socket 128, which can be connected with a complementary plug of a measuring transducer for forming a coupling between the compact transmitter 109 and the measuring transducer. Arranged within the plastic housing 125 is a circuit card 129, on which is arranged the transmitter circuit 108, as well as the first interface S2 serving for forming an inductive coupling with the complementary interface S1 (compare FIG. 2) of a measuring transducer connected in measurement operation with the compact transmitter 109.

In its end region lying opposite to the interface S2, the transmitter circuit arranged on the circuit card 129 is connected via an interface S3 (not shown) by means of a soldered connection 131 with a connection cable 113. Also arranged in this end region is a radiating element 133 of an antenna 132, which in the example of an embodiment shown here is embodied as a conductive trace structure arranged on the circuit card 129. Transmitter circuit 108 is connected via an interface S4 (compare also FIG. 2) with the antenna 132. Transmitter circuit 108 is embodied to supply the antenna 132, especially the radiating element 133, with a radio signal having a predetermined central wavelength λ, onto which a data signal to be transmitted is modulated. Interface S4 is, moreover, embodied to demodulate radio signals received by means of the antenna 132 and to transmit the demodulated data signals to the transmitter circuit 8.

Antenna 132 is initially matched to the central wavelength λ. The dimensions of the antenna 132 are so selected that antenna 132 acts as a slight modification of a classical monopole lambda/4 antenna, i.e. as an antenna, which is formed by the combination of, first of all, the radiating element 133, for instance, of length λ/4 (thus of a fourth of the central wavelength λ) and, secondly, a counterpart acting as a mirror structure: If one considers a rod of length L, which is placed in the geometric sense "normally" on a mirror, then this rod appears to an external observer to be a rod of length 2L. Resting on this principle is the operation of lambda/4 monopole antenna variants, which in the case of short characteristic lengths of only, for instance, λ/4 approximately achieves the characteristics of clearly larger lambda/2 antennas.

In the shown form of embodiment, the mirror surface is formed essentially by the copper structures of the circuit card 129, especially a ground plane advantageously arranged on an inner ply of the circuit card 129. In the specific form of embodiment shown here, it is, however, worth mentioning that the HF signals of the radiating element 133 are also reflected by the cable 113, which is thus likewise part of a mirror structure.

The interface S4 and/or the radiating element 133 includes optionally also one or more so-called matching networks, in which especially capacitors and coils in e.g. pi- or T-shaped topologies are connected for the purpose of suppressing reflections of the HF waves in the signal path from and to the antenna. In the present example, the central wavelength lies at 2.45 GHz, so that the length of the radiating element 133 amounts to, for instance, 3 cm. The radiating element 133 and the connection cable 113 extend, in each case, spaced from the cylinder axis Z and parallel to one another and to the cylinder axis Z (compare FIG. 3). In this way, in the case of compact construction of the cable transmitter 109, a maximum separation between the antenna 132, respectively the radiating element 133, and the connection cable 113 is implemented.

The soldered connection 131 and the radiating element 132 are arranged on oppositely lying sides of the circuit card 129. The circuit card 129 includes a ground plane (not shown in FIGS. 3-6) extending on one of its inner plies up to the base of the radiating element 133, which, such as already mentioned, serves as a mirror surface of the monopole lambda/4 antenna 132. Preferably, the ground plane extends also between the soldered connection arranged on the front side of the circuit card 129 131 and HF components of the interface S4 arranged with the radiating element 133 together on the oppositely lying, rear side of the circuit card 129.

For strain relief of the connection cable 113, such is secured in a region adjoining the solder joint 131 and extending at least sectionally still within the plastic housing 125 by means of a cable tie 139. Cable tie 139 engages in a surrounding groove of a sleeve 137 surrounding the circuit card 129 in this region and affixes the connection cable axially, so that a strain relief of the cable wires soldered onto the circuit card at the solder joint 131 is assured in the tight quarters. For example, the connection cable can have for supporting the axial fixing a plastic jacketing, which has a shoulder axially bearing against the cable tie or a corresponding protrusion axially abutting against the cable tie.

An important advantage of the form of embodiment of the antenna 132 shown in FIGS. 3 to 6 is that the antenna structures, especially the radiating element 133, are integral parts of the circuit card 129 and require for electrical connection no tolerance burdened solder locations or plug connections potentially detrimental relative to the HF properties. This feature enables forming especially in the region of the base of the radiating element 133 on the circuit card 129 copper structures, which act as part of a matching network, e.g. with inductive impedance, and can therewith serve in place of discrete components. Such circuit board structures, which act capacitively or inductively, are known in the state of the art in many different varieties and the integration (per the invention) of the radiating element 133 into the circuit card 129 gives a high measure of flexibility for the detailed design. Especially therewith, the embodiment of the radiating element 133 shown in FIG. 5 resembling the lowercase letter "h" becomes an option, in the case of which an inductively acting, grounded, branch line is connected laterally to the strip shaped, basic topology of the radiating element 133, so that a structure results, which corresponds, for instance, to the lowercase letter "h". The advantage of the extension of she the "I" shaped basic topology of the radiating element 133 with a branch line to a "h" shaped basic topology is e.g. that then one less discrete coil is required.

Figure 7:
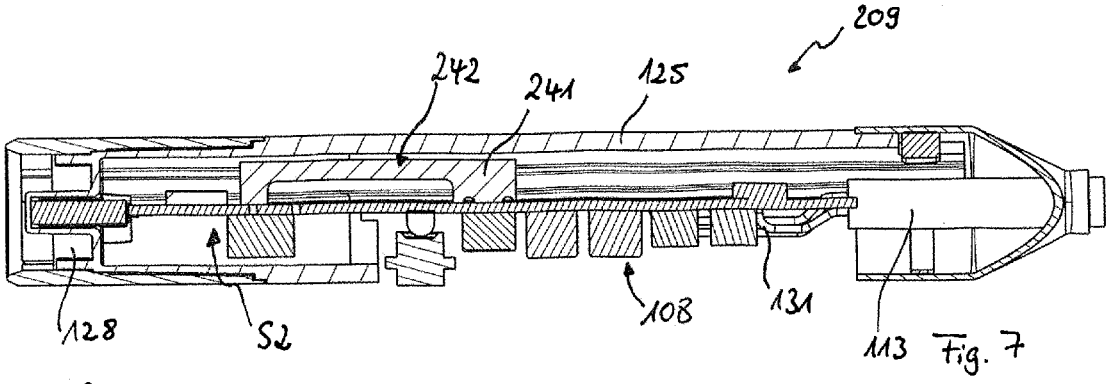
FIG. 7 is a sectional illustration of a compact transmitter with an antenna for establishing a radio connection with a superordinated data processing system according to a second example of an embodiment.
Figure 8:
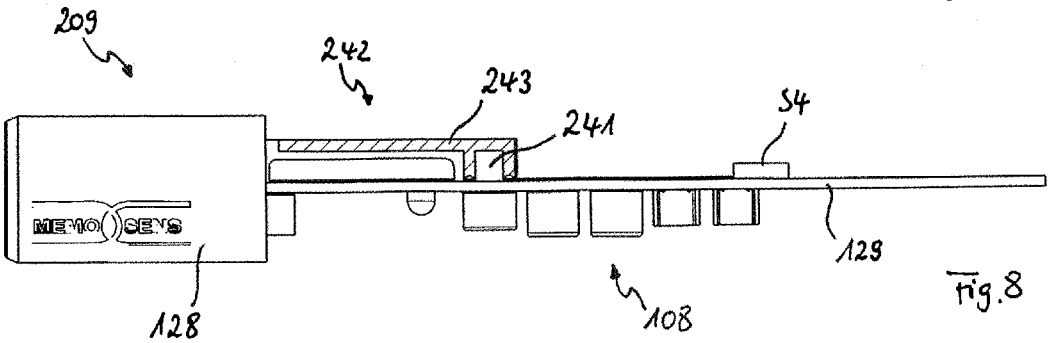
FIG. 8 is a detail view of the compact transmitter illustrated in FIG. 7, showing the radiating element of the antenna.

In an alternative example of an embodiment, the antenna of the compact transmitter can be implemented as an antenna with an L-shaped radiating element. FIG. 7 shows a sectional illustration of such a compact transmitter 209 equally suitable for application in a measuring arrangement according to FIGS. 1 and 2. Compact transmitter 209 is embodied essentially the same as the compact transmitter 109 shown in FIGS. 3 to 6. FIG. 8 shows a detail view of the compact transmitter 209 of FIG. 7, including the radiating element 243 of the antenna 242. Identical components are referred to with identical reference characters.

In this example, antenna 242 is embodied as a variation of a lambda/4 monopole antenna topology, i.e. as an antenna, which is formed by the combination of a radiating element, for instance, of length $\lambda/4$, thus a fourth of the central wavelength $\lambda$, to which the antenna is initially matched, and a metal structure serving as mirror surface. In contrast to the classical lambda/4 monopole antenna, the radiating element is angled, with, for instance, the length $\lambda/4$, L-shaped above a mirror element. In the present example, there is formed on an inner ply of the circuit card 129 a ground plane, which serves as the mirror element of the antenna 242. The HF components of the radio interface S4 can, such as in the earlier described example of an embodiment, be arranged on the rear side of the circuit card 129 lying opposite the antenna 243.

As in the case of the radiating element 133 of the first example of an embodiment described based on FIGS. 3 to 6, the radiating element 243 is formed by means of a conductive trace structure arranged on the circuit card 241 and gains thereby the advantage of the small manufacturing tolerances for circuit cards. Circuit card 241 extends perpendicularly to the circuit card 127, on which the transmitter circuit 108 as well as the components belonging to the different interfaces of the compact transmitter 209 are arranged. Advantageously, circuit card 241 is so designed, in such case, relative to the thickness of the material of the card that the end of the circuit card 241 has for the 90° mounting of the circuit card 241 on the circuit card 127 a large bearing surface, which suppresses tilting in the non-soldered state. Circuit card 241 is, consequently, provided with a thickness of 3.5 mm, which is unusual for circuit cards.

Circuit card 241 can be affixed on the circuit card 129, for example, by a soldered connection. This can be implemented in simple manner by cutting the circuit card 241 along one or more preformed vias, so that the internally metallized vias can be used as contact surface for a solder joint.

For electrical contacting of the HF components of the interface S4 by the antenna, basically only one solder joint is required. Advantageously, there is provided in the region of the solder joint on the circuit card 129 a so-called matching network, which performs an impedance transformation from the output of the HF semiconductor circuits onto the antenna base. Especially recommendable is to provide at the base an inductively acting compensation network connected to ground, which serves to compensate the parasitic capacitive coupling of the radiating element located on the circuit card 241 to the ground plane on the circuit card 129 arising especially from the L-shaped angling of the radiating element. Such matching networks are known in the state of the art in varied forms of embodiment and comprise especially networks which especially connect coils and capacitors in so called pi- or T-topologies.

Alternatively, to such a modified lambda/4 monopole antenna topology with only one HF connection, advantageous, in given cases, are also forms of embodiment of the radiating element 243 arranged on the circuit card 242 in so called "F-topology", which integrate, as conductive trace structures, parts of the matching network, especially the compensation inductance to ground recommendable for the matching network. Such an embodiment of the radiating element 243 is shown in FIG. 8. For this embodiment, the circuit card 241 gains, attached to the original L-shape, a second, L-shaped electrical connection, which is advantageously connected on the circuit card 127 with the ground plane. This structure is known as a so-called F-topology, since, upon supplementing of the L-shaped basic topology (such as shown in FIG. 8) with the compensation branch, an F-shaped structure arises. This structural feature, known from other circumstances in the case of antenna design, can also be utilized in this circumstance, in order to use fewer components for the matching network at the base of the radiating element and to embody the antenna a bit more compactly.

Advantageously, the mechanical mounting of the circuit card 241 on the circuit card 127 occurs by way of a second solder joint, which serves only for mechanically affixing the circuit card 241 to the circuit card 127. Advantageously, this is formed using a further sawed through, respectively milled through, via, which, in contrast to the connection at the base of the radiating element, is not electrically contacted.

The connection between the circuit card 129 and the connection cable 113 connecting the compact transmitter 209 with a superordinated data processing system can be embodied as in the example described based on FIGS. 3 to 6 in such a manner that the cable extends eccentrically from, and parallel to, a cylinder axis of the transmitter housing 125. Connection cable 113 can, however, also so extend from the transmitter housing that it coincides with the cylinder axis.

Figure 9:
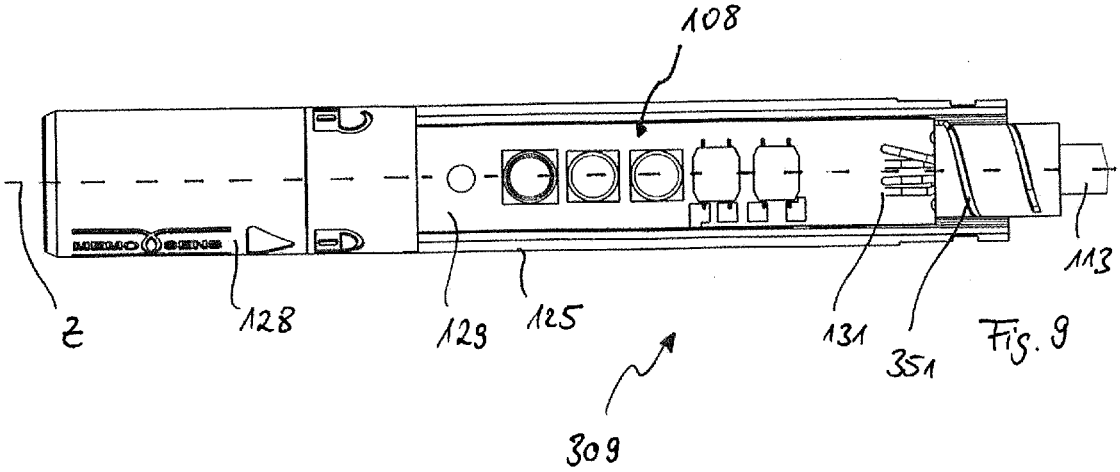
FIG. 9 is a sectional illustration of a compact transmitter with an antenna for establishing a radio connection with a superordinated data processing system according to a third example of an embodiment.

FIG. 9 shows another alternative form of embodiment of the invention, which combines the features of a lambda/4 monopole topology and a so-called helix topology. The compact transmitter 309 shown in FIG. 9 in a detail view with a view of a front side of the circuit card 129 is otherwise constructed essentially identically to the compact transmitters 109 and 209 shown in FIGS. 3 to 8, wherein identical components bear equal reference characters. In this form of embodiment, the, for instance, λ/4 long, radiating element 351 is wound concentrically worm or screw shaped around the connection cable 113. A ground plane arranged within the circuit card 128 acts also here as mirror element. The helical guiding of the radiating element 351 around the connection cable 113 reduces the axial length required for achieving the resonant frequency. Also here, the wound off length of the radiating element 351 equals, for instance, a fourth of the central wavelength λ, e.g. about 3 cm for about 2.5 GHz.

Common to the designing of the antenna structures is that, in an advantageous embodiment, decisive for the dimensions of the radiating elements and the mirror elements of the said antennas is not necessarily the central wavelength λ in vacuum, but, instead, the corresponding wavelength for the dielectric environment of the antenna structure. If e.g. the housing 125 is filled with a potting material, then in general this leads to a lessening of the relevant propagation velocity of the HF waves, which can be estimated via an index of refraction $n=\sqrt{\in_r}$, wherein $\in_r$ is the dielectric constant. A typical dielectric constant of, for instance, 3 results in a reduction of the propagation velocities and therewith the length measurement required for the antennas by a factor of about 1.7.

To be taken into consideration, in such case, is, moreover, that the index of refraction, and therewith the optimal length measurement for the antenna structures, in given cases, change, when housing or potting materials absorb, through diffusion, water with its high dielectric constant of about 81. An especially advantageous form of embodiment is that in which the housing is filled with a potting material based on silicone. Materials of this class of materials have the advantage that they can be manufactured to have extraordinarily small water uptake. An alternative advantageous form of embodiment is the application of potting materials based on polyurethane, since, while these can, indeed, absorb more moisture than comparable silicone materials, they nevertheless strongly limit water diffusion.

The invention claimed is:

1. A sensor for liquid and/or gas analysis, comprising:

a measuring transducer for producing a measurement signal; and a compact transmitter separably connected with said measuring transducer, which is embodied to receive and further process the measurement signal, wherein said compact transmitter includes:

a transmitter housing;

a transmitter circuit arranged in the transmitter housing;

a first interface arranged in said transmitter housing, via which said transmitter circuit is connectable by means of a connection cable with a first superordinated data processing system, especially one embodied as a superordinated control system; and a second interface arranged in said transmitter housing, which connects said transmitter circuit with an antenna and which is embodied to supply the antenna with, or to receive by means of the antenna, a radio signal, which has a central wavelength, λ, wherein the antenna includes a radiating element and at least one metal mirror element, the radiating element having a conductive trace structure applied on a circuit card, the at least one mirror element including a ground plane of metal arranged on an inner ply of said circuit card, and wherein said radiating element has a length of λ/8 up to 3λ/8, including λ/4.

2. The sensor as claimed in claim 1, wherein:

said second interface is embodied to supply the antenna with a radio signal and/or to receive such a radio signal from the antenna according to a Bluetooth standard energy saving mode, or according to the Bluetooth low energy protocol, or according to wireless HART.

3. The sensor as claimed in claim 1, wherein:

said measuring transducer and said compact transmitter are connected separably with one another by means of a connector coupling; and said compact transmitter includes a third interface embodied to transmit data signals obtained from said transmitter circuit to a complementary interface of said measuring transducer and to receive data signals from the interface of said measuring transducer and to transmit the data signals to said transmitter circuit, when said measuring transducer and said compact transmitter are connected by means of said connector coupling.

4. The sensor as claimed in claim 1, wherein:

said transmitter housing has at least one cylindrical section with an outer diameter of less than 30 mm.

5. The sensor as claimed in claim 1, wherein:

the antenna is embodied as a λ/4 monopole antenna or as an F antenna.

6. The sensor as claimed in claim 4, wherein:

at least one section of said radiating element and one section of said connection cable within said transmitter housing extend facing one another spaced from a cylinder axis of the cylindrical section of said transmitter housing.

7. The sensor as claimed in claim 1, wherein:

the conductive trace structure is copper.

8. The sensor as claimed in claim 1, wherein:

said radiating element has a base, via which the radiating element is connected with said second interface; and said circuit card has near the base a copper structure, which acts as part of a matching network, especially with inductive impedance, for compensating a capacitive coupling between said radiating element and said at least one mirror element.

9. The sensor as claimed in claim 1, wherein:

the ground plane is copper.

10. The sensor as claimed in claim 1, wherein:

said first interface is arranged at least partially on said circuit card, and said connection cable is connected via at least one soldered connection fixedly with said circuit card;

said second interface comprises HF circuit parts, which are arranged on the same circuit card as said first interface; and said HF circuit parts and the conductor structure forming said radiating element are arranged on an upper side of said circuit card, and the soldered connection of said connection cable is arranged on the underside of said circuit card opposite the upper side.

11. The sensor as claimed in claim 1, wherein:

said second interface is arranged on an additional circuit card arranged perpendicularly to and fixedly connected with the circuit card on which the conductor trace structure of the radiating element is formed.

12. The sensor as claimed in claim 11, wherein:

said first interface and/or said transmitter circuit are/is arranged at least partially on said additional circuit card;

said connection cable is connected fixedly with said additional circuit card via at least one soldered cable connection;

said second interface includes HF circuit parts arranged on said additional circuit card; and said HF circuit parts and a soldered card connection between said circuit card and said additional circuit card are arranged on an upper side of said additional circuit card, and the soldered cable connection of said connection cable is arranged on the underside of said additional circuit card opposite the upper side.

13. The sensor as claimed in claim 11, wherein:

said at least one metal mirror element includes a ground plane of an electrically conducting material arranged on an inner ply of said additional circuit card.

14. The sensor as claimed in claim 1, wherein:

said radiating element is led concentrically and helically around said connection cable.

15. The sensor as claimed in claim 14, wherein:

said first interface is arranged at least partially on the circuit card, and said connection cable is connected via at least one soldered connection fixedly with the circuit card; and said at least one mirror element is formed by a ground plane of metal arranged on an inner ply of the circuit card.

16. The sensor as claimed in claim 1, wherein:

said first interface is arranged at least partially on the circuit card, and said connection cable is connected with the circuit card via at least one soldered connection; and near the at least one soldered connection an apparatus for strain relief of said connection cable is arranged, the apparatus being formed of a dielectric material.

17. The sensor as claimed in claim 3, wherein:

said transmitter circuit includes a computer system and a memory associated with said computer system, wherein a computer program is stored in the memory, the computer program being executable by said computer system and serving for further processing of the data signals transmitted via said third interface from said measuring transducer connected with said compact transmitter and for transmission of the further processed data signals via said first interface to the first superordinated data processing system.

18. A compact transmitter including a sensor as claimed in claim 17, wherein:

there is stored in said memory associated with said computer system a computer program, which is executable by said computer system and which serves for transmission of the further processed data signals and/or other data via said second interface per radio to a second data processing system.

19. A measuring arrangement comprising:

a sensor as claimed in claim 3, and further comprising:

connected with said compact transmitter via said second interface, a first superordinated data processing system embodied as a control system; and a second superordinated data processing system connected with said transmitter circuit via a radio connection to said third interface, the superordinated data processing system embodied as a handheld, smart phone, tablet PC, notebook or as a display system embodied for wireless communication with the evaluation circuit.

20. The measuring arrangement as claimed in claim 19, wherein:

said transmitter circuit is embodied to determine based on the measurement signal a measured value of the measured variable to be monitored by the sensor, to convert the calculated measured value into a signal according to a communication protocol processable by said first and/or said second data processing system, and to forward the signal to the first and/or the second data processing system.

21. The measuring arrangement as claimed in claim 19, wherein:

said second superordinated data processing system communicates with said transmitter circuit via a radio connection according to a Bluetooth standard energy saving mode, or according to the Bluetooth low energy protocol, or according to wireless HART via the third interface of the compact transmitter.

* * * * *